US008621787B2

(12) United States Patent
Barry et al.

(10) Patent No.: US 8,621,787 B2
(45) Date of Patent: Jan. 7, 2014

(54) PREFABRICATED BUILDING MODULES FOR MULTI-UNIT HOUSING

(75) Inventors: Michael I. Barry, Short Hills, NJ (US); David Barry, Hoboken, NJ (US); Erikjan Vermeulen, Amsterdam (NL); Rob Wagemans, Amsterdam (NL)

(73) Assignee: Ironstate Development, LLC, Hoboken, NJ (US)

( * ) Notice: Subject to any disclaimer, the term of this patent is extended or adjusted under 35 U.S.C. 154(b) by 0 days.

(21) Appl. No.: 12/693,257

(22) Filed: Jan. 25, 2010

(65) Prior Publication Data

US 2011/0179721 A1 Jul. 28, 2011

(51) Int. Cl.

| | |
|---|---|
| ***E04H 1/00*** | (2006.01) |
| ***E04B 1/00*** | (2006.01) |
| ***E04B 1/343*** | (2006.01) |

(52) U.S. Cl.

USPC ..... 52/79.1; 52/36.1; 52/79.2; 52/79.8; 52/79.12; 52/220.1; 52/238.1; 52/745.02

(58) Field of Classification Search

USPC ..... 52/238.1, 79.1, 79.8, 220.1, 220.7, 52/36.1, 79.2, 79.3, 79.12, 745.02

See application file for complete search history.

(56) References Cited

U.S. PATENT DOCUMENTS

| | | | | | |
|---|---|---|---|---|---|
| 2,499,498 | A | * | 3/1950 | Hammond, Jr. | 52/67 |
| 3,455,620 | A | * | 7/1969 | Coburn | 433/29 |
| 3,616,592 | A | * | 11/1971 | Rothman | 52/705 |
| 3,623,296 | A | * | 11/1971 | Santoro | 52/79.12 |
| 3,638,380 | A | * | 2/1972 | Perri | 52/79.12 |
| 3,710,534 | A | * | 1/1973 | McNamara, Jr. | 52/745.03 |
| 3,721,056 | A | * | 3/1973 | Toan | 52/236.6 |
| 3,810,335 | A | * | 5/1974 | McCrillis et al. | 52/79.1 |
| 3,852,924 | A | * | 12/1974 | Levenson | 52/79.2 |
| 3,863,404 | A | * | 2/1975 | Wahlquist | 52/27 |
| 3,900,994 | A | * | 8/1975 | Van der Lely | 52/72 |
| 3,997,220 | A | * | 12/1976 | Mayer | 312/242 |
| 4,006,566 | A | * | 2/1977 | Forgiarini | 52/64 |
| 4,074,475 | A | * | 2/1978 | Wahlquist | 52/70 |
| 4,098,039 | A | * | 7/1978 | Sutelan | 52/73 |
| 4,221,441 | A | * | 9/1980 | Bain | 312/228 |
| 4,478,467 | A | * | 10/1984 | Tyndall | 312/249.9 |
| 4,667,580 | A | * | 5/1987 | Wetzel | 454/187 |
| 4,715,154 | A | * | 12/1987 | Baloga | 52/239 |
| 4,766,708 | A | * | 8/1988 | Sing | 52/167.8 |
| 4,876,835 | A | * | 10/1989 | Kelley et al. | 52/239 |
| 5,233,808 | A | * | 8/1993 | Salmenmaki et al. | 52/745.02 |
| 5,291,700 | A | * | 3/1994 | Chew | 52/36.1 |
| 5,452,547 | A | * | 9/1995 | Baloga et al. | 52/32 |

(Continued)

FOREIGN PATENT DOCUMENTS

WO WO 2008127198 A1 * 10/2008

*Primary Examiner* — Basil Katcheves
*Assistant Examiner* — Rodney Mintz
(74) *Attorney, Agent, or Firm* — Choate, Hall & Stewart LLP; William R. Haulbrook; Daniel S. Matthews

(57) ABSTRACT

The present application is directed towards systems and methods for building a living space during construction of a multi-unit housing structure. In particular, the present application describes various embodiments of prefabricated building modules that may be built and equipped with plumbing, HVAC and/or electrical fixtures prior to installation in a multi-unit housing structure. Because modules may be configured prior to installation in a housing structure, the use of prefabricated building modules may increase efficiency of construction and provide enhanced customization over other non-configurable building units.

19 Claims, 10 Drawing Sheets

(56) References Cited

U.S. PATENT DOCUMENTS 5,528,866 A * 6/1996 Yulkowski ..... 52/79.12
5,651,219 A * 7/1997 Baloga et al. ..... 52/32
5,775,034 A * 7/1998 Logue ..... 52/36.1
5,782,045 A * 7/1998 Paschal ..... 52/220.8
5,967,632 A * 10/1999 Lamia ..... 312/209
6,082,053 A * 7/2000 Bischof et al. ..... 52/64
6,131,347 A * 10/2000 Hornberger et al. ..... 52/238.1
6,179,358 B1 * 1/2001 Hirayama et al. ..... 296/24.38
6,243,993 B1 * 6/2001 Swensson ..... 52/79.5
6,256,936 B1 * 7/2001 Swensson et al. ..... 52/35
6,257,523 B1 * 7/2001 Olliges ..... 244/118.5
D450,132 S * 11/2001 Garner et al. ..... D25/1
6,405,388 B1 * 6/2002 Brown ..... 4/619
6,405,491 B1 * 6/2002 Gallant ..... 52/36.1
6,470,630 B1 * 10/2002 Miyamoto ..... 52/64
6,604,709 B1 * 8/2003 Wentland et al. ..... 244/118.5
6,625,937 B1 * 9/2003 Parker et al. ..... 52/79.7
6,663,267 B2 * 12/2003 Newhouse et al. ..... 362/431
6,732,769 B2 * 5/2004 Del Campo ..... 141/97
6,820,375 B2 * 11/2004 Meeker ..... 52/36.1
6,981,347 B1 * 1/2006 Walburger ..... 52/79.1
D561,910 S * 2/2008 Wagemans ..... D25/35
7,540,120 B2 * 6/2009 Miller ..... 52/236.3
7,794,001 B2 * 9/2010 Blackwell et al. ..... 296/24.38
7,921,609 B2 * 4/2011 Kordelin ..... 52/79.9
D641,494 S * 7/2011 Wagemans et al. ..... D25/1
8,033,067 B2 * 10/2011 Miller ..... 52/236.3
8,074,403 B1 * 12/2011 Mentnech ..... 52/72
8,091,301 B2 * 1/2012 Van Klaveren ..... 52/243.1
8,112,944 B2 * 2/2012 Miller et al. ..... 52/79.7
8,166,714 B2 * 5/2012 Ziegelman ..... 52/79.2
8,186,109 B2 * 5/2012 Warminsky ..... 52/79.1
8,291,647 B2 * 10/2012 Esposito ..... 52/66
8,381,453 B2 * 2/2013 Lim ..... 52/79.2
8,402,700 B2 * 3/2013 Hall et al. ..... 52/67
2002/0189173 A1 * 12/2002 Staschik ..... 52/79.1
2003/0070367 A1 * 4/2003 Gelin et al. ..... 52/144
2003/0101680 A1 * 6/2003 Lee ..... 52/745.2
2003/0150178 A1 * 8/2003 Bergman ..... 52/234
2003/0159366 A1 * 8/2003 Christensen ..... 52/79.1
2003/0182884 A1 * 10/2003 Kishimoto et al. ..... 52/238.1
2003/0188507 A1 * 10/2003 Cote, Jr. ..... 52/741.1
2003/0205022 A1 * 11/2003 Mawby et al. ..... 52/745.02
2003/0213184 A1 * 11/2003 Hunt et al. ..... 52/36.1
2003/0226323 A1 * 12/2003 Travez et al. ..... 52/220.7
2004/0003545 A1 * 1/2004 Gillespie ..... 52/36.1
2004/0035060 A1 * 2/2004 Miyazaki et al. ..... 52/29
2004/0103593 A1 * 6/2004 Beasley ..... 52/64
2004/0118054 A1 * 6/2004 Thompson ..... 52/36.1
2005/0150175 A1 * 7/2005 Guigan ..... 52/36.1
2006/0277838 A1 * 12/2006 Travez et al. ..... 52/79.1
2007/0193124 A1 * 8/2007 Thompson ..... 52/36.1
2007/0204524 A1 * 9/2007 Kern et al. ..... 52/36.1
2008/0098663 A1 * 5/2008 Seel ..... 52/36.1
2008/0264578 A1 * 10/2008 Goodman et al. ..... 160/202
2009/0025321 A1 * 1/2009 Cherney et al. ..... 52/238.1
2009/0223143 A1 * 9/2009 Esposito ..... 52/79.1
2009/0319606 A1 * 12/2009 Monteverde et al. ..... 709/204
2010/0024352 A1 * 2/2010 Pope ..... 52/745.02
2010/0058675 A1 * 3/2010 Simmons ..... 52/79.1
2010/0088974 A1 * 4/2010 Scott, IV ..... 52/79.5
2010/0126082 A1 * 5/2010 McLuskey ..... 52/79.7
2010/0132271 A1 * 6/2010 Fernandez Fernandez .... 52/79.9
2011/0041415 A1 * 2/2011 Esposito ..... 52/12
2011/0056147 A1 * 3/2011 Beaudet ..... 52/79.9
2011/0083379 A1 * 4/2011 Lavi ..... 52/79.1
2011/0173898 A1 * 7/2011 Denicourt et al. ..... 52/79.1
2011/0202396 A1 * 8/2011 Viveiros et al. ..... 705/14.4
2012/0180425 A1 * 7/2012 Dooley et al. ..... 52/745.02
2012/0311938 A1 * 12/2012 Larson ..... 52/79.1
2013/0014450 A1 * 1/2013 Esposito ..... 52/11
2013/0014451 A1 * 1/2013 Russell et al. ..... 52/79.1

* cited by examiner

PREFABRICATED BUILDING MODULES FOR MULTI-UNIT HOUSING

FIELD OF THE INVENTION

The present application generally relates to building structures. In particular, the present application relates to systems and methods for efficient construction of a living space during construction of a multi-unit housing structure using highly configurable and customizable building modules.

BACKGROUND OF THE INVENTION

Constructing a multi-unit housing structure may be expensive and time consuming, particularly in the fitting out of each housing unit. Each housing unit may require plumbers, electricians, joiners, carpenters, and other skilled tradesmen for the installation of different fixtures. Additionally, installing these fixtures after construction of interior and exterior walls prevents this interior work from being performed concurrently with construction of the building.

BRIEF SUMMARY OF THE INVENTION

Construction of a multi-unit residence or housing complex may require the services of various tradesmen, including plumbers, electricians, carpenters, plasterers, painters, and other workers in finishing the interior of each unit. Their activities need to be well coordinated, because some tasks may need to occur before others. For example, it may be more efficient and less expensive to install interior plumbing and electrical lines before drywall is installed. Furthermore, in a large multi-unit building, multiple activities may be performed concurrently to meet project deadlines, such as structural construction on a top floor, interior framing on the next floor down, electrical and plumbing work on the next floor, drywall on the following floor, etc.

When issues and complications inevitably occur during construction, from minor punch list changes to major design revisions or delays with ordering custom fixtures, a tight construction schedule will need to be changed and extended, resulting in increased costs and delay. Bathrooms, for example, require plumbing and electrical fixtures, cabinetry, different accessories such as towel racks, mirrors, lighting, and other features. Minor errors or design changes may be present in any of these, and as a result, bathrooms usually end up with the largest number of construction punch list items to be addressed.

One way to reduce the effects of these complications is to reduce flexibility and customization of individual units: if every unit is identical, then it's easier to maintain consistent quality and bulk-order materials. However, this may reduce the marketability of individual units or disappoint potential buyers.

The present application describes prefabricated building modules that may be constructed and outfitted on or off-site, and placed within a unit during construction. A building module may be created of various materials, and may contain both an interior finished space, and exterior finished surfaces. For example, the interior of a building module may be configured as a bathroom, with a tile floor and walls, a toilet, a shower and/or bath, a sink, a mirror or mirrors, electrical outlets and light switches, ventilation and heating, and other features.

Any of the exterior walls of the module may be used to define or provide other types of living spaces. Using the same wiring and plumbing, one side of the exterior of the building module may include a sink, countertops and cabinetry and appliance connections for a kitchen. Another side may include electrical and cable connections for a home entertainment center. Yet another side may include closet or wardrobe space. Each side may be finished with different surfaces, responsive to the wishes of the buyer or designer. For example, the side of a module designed to determine one border of a kitchen may have a marble backsplash and plaster walls, while a different side designed to border a bedroom may have hardwood walls and an alcove for a flat screen television.

In some embodiments, the building module is shorter in height than the ceiling of the housing unit. This allows the building module to slide or fit into the housing unit without being attached to or integrated with the ceiling or walls of the housing unit. As the building module may be mounted only to the floor of the housing unit, the building unit may be positioned or located any where within the housing unit. In some cases, the building module may be positioned centrally to any of the interior walls of the housing unit. In other cases, the building module may be positioned adjacent to or near any interior wall of the housing unit. These building modules may be designed and constructed to any dimensions desired and suitable for the housing unit. This allows great configurability, creativity and flexibility in defining the living space using this building module.

In some embodiments, the building module may be designed and constructed to provide lighting for both the interior of the building module as well as the living space exterior to the building module. With a predetermined gap between the height of the building module and the ceiling of the housing unit, the building module may include lighting on top or near the top of the building module such that the light emanates into surrounding living space as well as the interior of the building module. For the example, light from the building module may reflect off the unit's ceiling to provide diffuse illumination.

Additionally, the building module may include sliding or extendable dividers or partitions that can be extended from the module outwardly to the walls of the housing unit to define different living space within the unit. For example, a building module may be installed near the center of a housing unit and partitions may be extended out from two adjacent faces of the building module to two adjacent walls of the housing unit to enclose a section of the housing unit, for example, a bedroom. When a resident awakes in the morning, they may slide the partitions back into the building module, opening up the space again. Thus, the partitions allow the resident to dynamically reconfigure their living space at will.

In some embodiments, the prefabricated building modules of the present application may be slid or moved into a unit during construction. For example, the building module may be placed on a rolling platform or other mechanism, or include a rolling mechanism, and may be maneuvered into place and mounted or bolted to the floor of the unit. Plumbing and electrical hookups may be made to the module using standardized connectors. Accordingly, installation of a module into each unit may be performed quickly and inexpensively by a small number of laborers, after the designer or buyer has reviewed and confirmed the outfitting, ensuring high quality and consistency and reducing on-site issues. Additionally, because the module may be moved around prior to installation, each unit may be constructed with a customized floor plan. For example, one unit may be constructed based around a single module, while another unit may include two or three or more modules.

The modules may also be positioned differently within the unit, creating and delineating different living areas such as a bedroom, living room, dining room, kitchen, or other area, through the use of movable partitions that extend from the building module to the walls of the unit for privacy and noise control. For example, in one unit, a module may be positioned in the center of the unit, so that living areas around the module are of approximately equal size, while in another unit, a module may positioned off-center. In another example, one buyer may wish to have a small bedroom and a large living room area, while another buyer may wish to have a master bedroom, a smaller second bedroom, and a small living room area. The possibility of multiple building modules being installed in a unit, either adjacent or non-adjacent, gives the buyer even more options with little-to-no additional cost of construction.

Separate from physical construction of the housing unit, each building module may be outfitted with standard or custom fixtures, responsive to the buyer's wishes. For example, one building module may include a bathroom with a shower, while another may include a bath. In a further example, one bathroom may have standard plumbing fixtures, while another may have deluxe designer fixtures. Because installation of fixtures may be performed separately from construction of the building, buyers can have an increased number of customization options, and installers can ensure consistently high quality without expensive post-construction repair and replacement.

Thus, the building modules described in the present application may provide enhanced quality control and consistency, reduce costs and time of construction and increase efficiency of labor, and create greater flexibility and customization for designers and buyers.

The present application is directed towards systems and methods for building a living space during construction of a housing unit, such as a multi-unit housing structure. In particular, the present application describes various embodiments of prefabricated building modules that may be built and equipped with plumbing, HVAC and/or electrical fixtures prior to installation in a multi-unit housing structure. Because modules may be configured prior to installation in a housing structure, the use of prefabricated building modules may increase efficiency of construction and provide enhanced customization over other non-configurable building units.

In one aspect, the present application features a prefabricated building module, which may at times be referred to as a self-contained unit, a preconstructed building module, a service area or prefabricated living space or room. The prefabricated building module includes a set of adjoining peripheral walls having finished inner wall surfaces and finished outer wall surfaces, and one or more partition elements mounted to the building module and movable between a first, retracted position and a second, extended position to define, with opposed surfaces of the housing unit, a living space exterior to the building module. In some embodiments, the finished inner wall surfaces of the set of adjoining peripheral walls define a living space within the prefabricated module. In another embodiment, the finished outer wall surfaces are configured, when installed in a housing unit, to define limiting walls of multiple functional living spaces arranged about the prefabricated module in the housing unit. In yet another embodiment, the prefabricated module is sized and configured for installation within a housing unit with the finished outer wall surfaces spaced apart from walls of the housing unit such that the prefabricated module separates at least one of the living spaces from another of the living spaces.

In one embodiment, the prefabricated module includes plumbing fixtures mounted within the interior of the module. A prefabricated module of a bathroom may be referred to as a service area or wet area. In a further embodiment, the plumbing fixtures include a toilet and a sink. In a still further embodiment, the plumbing fixtures include a shower head. In another embodiment, the finished inner surfaces of the service module includes a water-resistant floor. In a further embodiment, the finished inner surfaces of the service module include wall portions with one or more water-resistant regions extending upwards from the water-resistant floor.

In some embodiments, the finished outer wall surfaces of the module define a vanity alcove containing a sink. In other embodiments, the living space exterior to the building module defines an enclosable dressing area. In still other embodiments, the one or more partitions, in retracted position, are received into pocket defined by the building module.

In another embodiment, the prefabricated module includes drawers and racks for storing clothing and other items. In another embodiment, the finished outer wall surfaces of the module define a recess of a size suitable to receive a flat screen video device. In another embodiment, the building module is wired for electrical service. In a further embodiment, the finished outer wall surfaces include electrical outlets. In another further embodiment, the niche of a size suitable to receive the flat screen video device includes electrical outlets. In another embodiment, the finished outer wall surfaces of the module include utility connections for kitchen appliances. In another embodiment, the prefabricated module includes one or more surfaces configured to connect with a second prefabricated module.

In another aspect, the present application features a method of creating a housing unit that comprises incorporating a prefabricated building module into a housing unit to define a living space. The method includes constructing a housing unit with predetermined dimensions. The method also includes providing a living space or service area in the housing unit by installing a prefabricated first module containing a service area such that finished outer wall surfaces of the first module are spaced apart from walls of the housing unit in a manner to define, with the walls of the housing unit, limiting walls of one or more living spaces arranged about the prefabricated module in the housing unit.

In one embodiment, the method includes installing the prefabricated building module service area with finished outer wall surfaces spaced apart from walls of the housing unit by a distance corresponding to a distance that a partition, in extended position, is extendable outward from a finished outer wall surface of the first module to define, with opposed surfaces of the building module and the housing unit, a further living space exterior to the building module. In a further embodiment, the module is sized, configured, and positioned in the housing unit such that the prefabricated module defines and accessorizes at least one or more living spaces from another living space.

In another embodiment, the method includes providing a second living space area in the housing unit by installing a pre-constructed second module containing another area for the housing unit, such that finished outer wall surfaces of the second module are spaced apart from walls of the housing unit by a distance corresponding to a distance that a partition disposed within a wall of the second module is extendable outward from one of the finished outer wall surfaces of the second module. In a further embodiment, the method includes installing one or more surfaces extending between the first module and the second module.

In still another aspect, the present application features a prefabricated building module defining at least a portion of a predetermined type of living space for a housing unit and having mounted partitions extendable outwardly from the prefabricated building module to define one or more additional living spaces within the housing unit adjacent to the prefabricated building module. The prefabricated building module includes a set of adjoining walls having inner wall surfaces and outer wall surfaces, the set of adjoining walls defining at least a portion of a predetermined type of living space for a housing unit. The prefabricated building module also includes one or more fixtures designed for the predetermined type of living space, the one or more fixtures mounted via a structure attached to an interior of the prefabricated building module bound by the inner wall surfaces. The prefabricated building module also includes one or more partitions mounted between an inner wall surface and an exterior wall surface of the prefabricated building module, the one or more partitions extendable outwardly from a retractable position within the prefabricated building module to define at least a portion of one or more living spaces adjacent to the prefabricated building module within the housing unit.

In some embodiments, one of the inner wall surfaces or the outer wall surfaces of the prefabricated building module are finished. In another embodiment, the predetermined type of living space of the prefabricated building module comprises a bathroom.

In another embodiment, a height of one of the inner wall surfaces or the outer wall surfaces of the prefabricated building module are within a predetermined distance below a ceiling height of the housing unit. In some embodiments, the one or more partitions of the prefabricated building module are moveable between a first, retracted position and a second, extended position to define the portion of one or more living spaces adjacent to the prefabricated building module.

In some embodiments, a second set of one or more fixtures designed for a second predetermined type of living space are mounted to one or more outer wall surfaces of the prefabricated building module. In a further embodiment, the second predetermined type of living space comprises a kitchen.

In many embodiments, one or more lights are mounted within the interior of the prefabricated building module at a location to emanate light externally from the prefabricated building module lengthwise along a predetermined gap between an outer wall surface and a ceiling of the housing unit, the one or more lights providing light for the interior of the prefabricated building module and one or more living spaces adjacent to the prefabricated building module.

In some embodiments, the prefabricated building module is attached to a second prefabricated building module defining at least a portion of a third predetermined type of living space for the housing unit. In a further embodiment, one of the predetermined type of living space or the second predetermined type of living space or the third predetermined type of living space comprises a closet, a utility room, a bedroom, a living room, a den, an office or a library.

In another aspect, the present invention features a method for incorporating a prefabricated building module into a housing unit. The method includes receiving, at a location of a housing unit, a prefabricated building module, the prefabricated building module defining at least a portion of a predetermined type of living space for the housing unit and having mounted partitions extendable outwardly from the prefabricated building module to define one or more additional living spaces within the housing unit adjacent to the prefabricated building module. The method also includes moving the prefabricated building module within the housing unit, a height of the prefabricated building module falling below a ceiling height of the housing unit. The method further includes identifying within the housing unit a first living space provided by the prefabricated building module and a second living space provided by space adjacent to the prefabricated building module and one or more interior walls of the housing unit.

In one embodiment, receiving a prefabricated building module includes building the prefabricated building module at the location of the housing unit. In another embodiment, receiving a prefabricated building module includes assembling portions of the prefabricated building module at the location of the housing unit.

In one embodiment, moving the prefabricated building module within the housing unit includes sliding the prefabricated building module into the housing unit, the height of the prefabricated building module fitting under the ceiling height of the housing unit.

In one embodiment, the method includes the prefabricated building module not being attached to any interior wall of the housing unit.

In some embodiments, moving the prefabricated building module within the housing unit includes integrating the one or more fixtures of the prefabricated building module with one or more corresponding HVAC, plumbing or electrical system of the housing unit.

In other embodiments, the method includes establishing a lighting system within the first living space provided by the prefabricated building module that emanates light into the second living space via the prefabricated building module lengthwise along a predetermined gap between an outer wall surface of the prefabricated building module and a ceiling of the housing unit, the lighting system emanating light to the interior of the prefabricated building module.

In one embodiment, identifying within the housing unit a first living space includes extending a partition of the one or more partitions from a retracted position within the prefabricated building module to an extended position, adjacent to or flushed to an interior wall of the housing unit. In another embodiment, identifying within the housing unit a first living space includes extending the one or more partitions of the prefabricated building module to define one or more additional living spaces within housing unit.

In still another embodiment, the method includes installing a second prefabricated building module into the housing unit to provide a third living space within the housing unit.

The details of various embodiments of the invention are set forth in the accompanying drawings and the description below.

BRIEF DESCRIPTION OF THE FIGURES

The foregoing and other objects, aspects, features, and advantages of the invention will become more apparent and better understood by referring to the following description taken in conjunction with the accompanying drawings, in which.

Figure 1A:
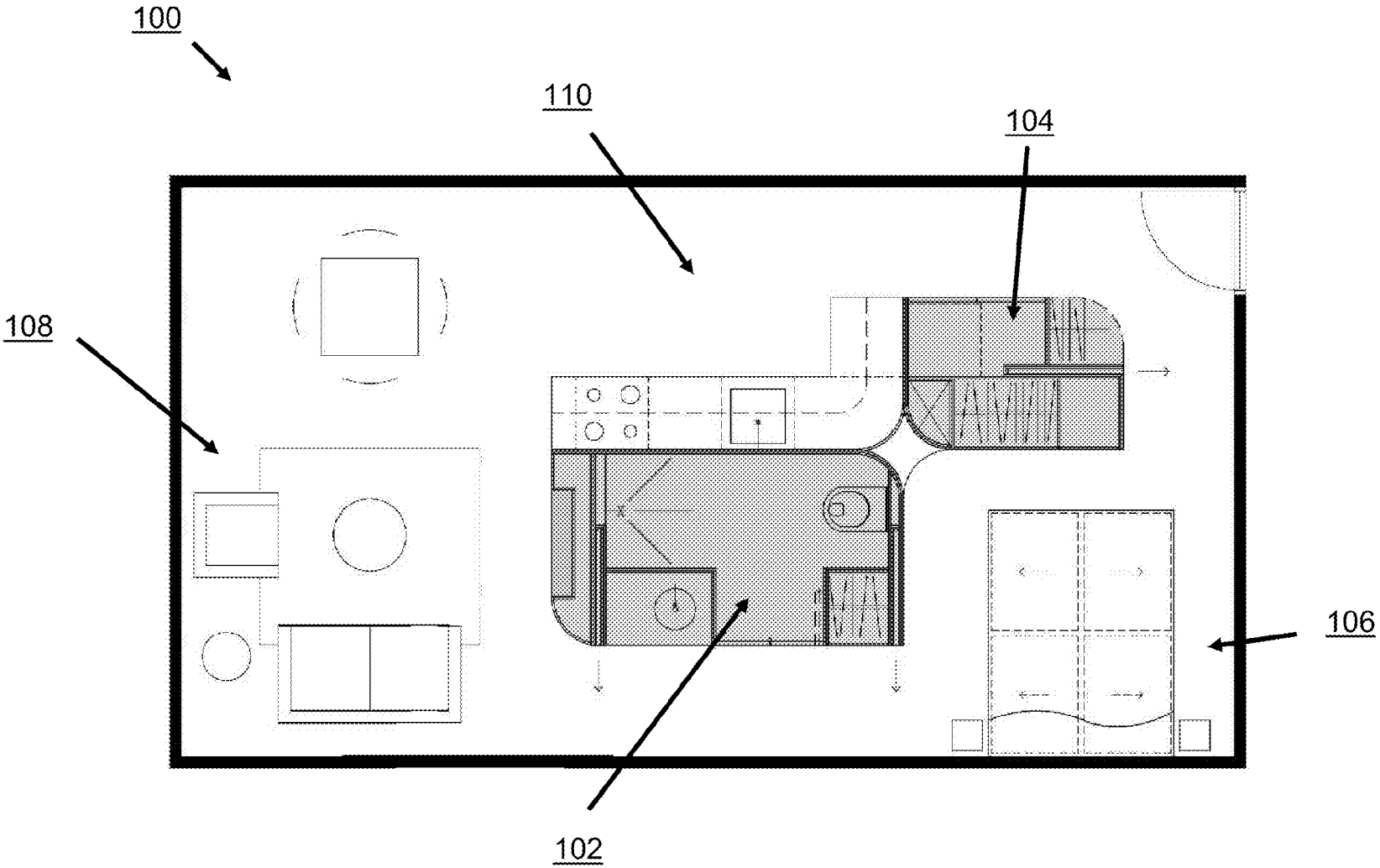
FIG. 1A is a floor plan of an embodiment of a housing unit with a plurality of prefabricated building modules.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION OF THE INVENTION

Referring first to FIG. 1A, shown is a floor plan of an embodiment of a housing unit with a plurality of prefabricated building modules. Briefly, a housing unit 100 may comprise one or more prefabricated building modules 102 and 104. Prefabricated building modules 102 and/or 104 may be positioned such that one or more living spaces may be defined external to the prefabricated building module, such as one or more bedrooms 106, living room or dining rooms 108, and a kitchen 110.

Still referring to FIG. 1A, and in more detail, a housing unit 100 may comprise one or more walls to define the extents of a housing unit. The one or more walls may be made of any material or combination of materials suitable for building construction, including wood, concrete, drywall, brick, cinderblock, metal, plaster, and plastic. In some embodiments, the one or more walls may comprise one or more doors or entrances. In other embodiments, the one or more walls may comprise one or more windows. In some embodiments, the one or more walls may comprise electrical outlets. Although only one housing unit 100 is illustrated, a multi-unit building may comprise a plurality of adjacent housing units 100, and may comprise one or more adjacent floors of housing units 100. The multi-unit building may, accordingly, further comprise one or more hallways between housing units 100, stairs, elevators, lobbies, or other building features.

In some embodiments, a prefabricated building module 102 and/or a building module 104 may be installed in housing unit 100, each discussed in more detail below. A module may be referred to variously and interchangeably as a prefabricated building module, a pre-constructed building module, a building module, a service area, a module, a prefabricated living space, a prefabricated room, or any similar term. Furthermore, although referred to as prefabricated or pre-constructed, in some embodiments, the building module may be partially or fully fabricated during installation, discussed in more detail below. As shown, a building module 102 and 104 may comprise prefabricated modules with one or more fixtures and/or storage spaces configured within said modules. In some embodiments, a building module 102 may comprise a bathroom and/or shower room, and may be referred to as a wet module. In some embodiments, a building module 104 may comprise a storage unit or utility room, and may be referred to as a storage module. As shown, a plurality of building modules may be installed in a unit such that the exterior surfaces of the building modules define one or more additional spaces within the housing unit 100. For example, in FIG. 1A, the rightmost wall of module 102 and the bottommost wall of module 104, along with opposing walls of the housing unit 100, define a bedroom 106. Similarly, the topmost wall of module 102 and the leftmost wall of module 104 define a kitchen 110. Additional space within housing unit 100 may be further defined by the positioning of the modules 102 and 104. For example, a living room 108 may be defined responsive to the positioning of module 102.

In many embodiments, a building module 102 and/or building module 104 may include a predetermined type of living space, such as a bathroom or shower room, discussed above as a wet module. In other embodiments, a building module 102 and/or building module 104 may include a different predetermined type of living space, including a closet, a utility room, a bedroom, a living room, a den, an office, or a library. Accordingly, a building module 102 or building module 104 may be of sufficient length and width to include one or more of these predetermined type of living spaces. A building module may be designed and constructed for any suitably desired dimension and for any desired portion of a housing unit.

Although building modules 102 and 104 are illustrated with exterior walls on all sides, in some embodiments, a building module may comprise exterior walls on fewer than all sides. For example, a building module may comprise three exterior walls with no fourth wall, such that the building module defines a non-enclosed space. In another example, a building module may comprise two adjacent exterior walls with no additional walls, such that the external space defined by the building module is combined with the internal space defined by the building module to create a contiguous space. In some embodiments, a building module may comprise walls of different heights, such as a full wall adjoining a half-wall or a three-quarters wall. In some embodiments, a building module may have one or more doors. In some embodiments, a building module may have one or more windows.

The building module may define any shape, such as a square, rectangular, half-moon, elliptical, octagon, pentagon, etc. As such, one or more of the walls may be curved and not straight walls. Any of the adjoining walls may form any degree of any angle, such as an angle between 0 and 180 degrees. Although illustrated as rectangular in FIG. 1A, in some embodiments, a building module may have three straight walls and enclose a triangular space, or have five straight walls and enclose a pentagonal space. In other embodiments, a building module may comprise more or fewer straight walls, or comprise one or more curved walls, to enclose or define a regular or irregular space. In one such embodiment, a building module may comprise one curved wall that defines or encloses an interior space. Thus, in some embodiments, a building module 102 or 104 may have one or more straight walls or one or more curved walls.

In many embodiments, a building module may include a floor and/or a ceiling attached to the one or more walls. In other embodiments, the building module may contain only a floor, only a ceiling, or neither. In many embodiments, the building module may have a height within a predetermined distance below a ceiling height of the housing unit. For example, if the ceiling of the housing unit is 10 feet above the floor of the housing unit, the building module may be less than 10 feet tall, such that there is a gap of a predetermined distance between the building module and the ceiling of the housing unit. As discussed below, this gap allows for the building module to be slid or rolled into place in the housing unit via a dolly, forklift, crane, or other means after the ceiling of the housing unit has been constructed. The predetermined distance can be in any unit of measurements, and may be inches, or may be a foot or more.

In many embodiments, the building module may include one or more lighting fixtures for illuminating the interior of the building module and/or the exterior spaces of the housing unit. For example, in one embodiment, the building module may include lighting fixtures located on the top of the one or more walls that provide direct illumination into the interior space of the module or exterior space between the module and the exterior walls of the housing unit, and/or provide indirect illumination via reflection off the ceiling of the housing unit. In other embodiments, such as where the building module includes a ceiling, the module may include internal lighting fixtures to illuminate the interior of the module, and one or more external lighting fixtures to illuminate the exterior spaces around the module via direct or indirect illumination. In some embodiments, lighting fixtures may be located on the interior and/or exterior walls of the building module, such as wall sconces. In many embodiments, the building module may include multiple fixtures such that different areas or zones of the housing unit and building module may be illuminated individually.

Figure 1B:
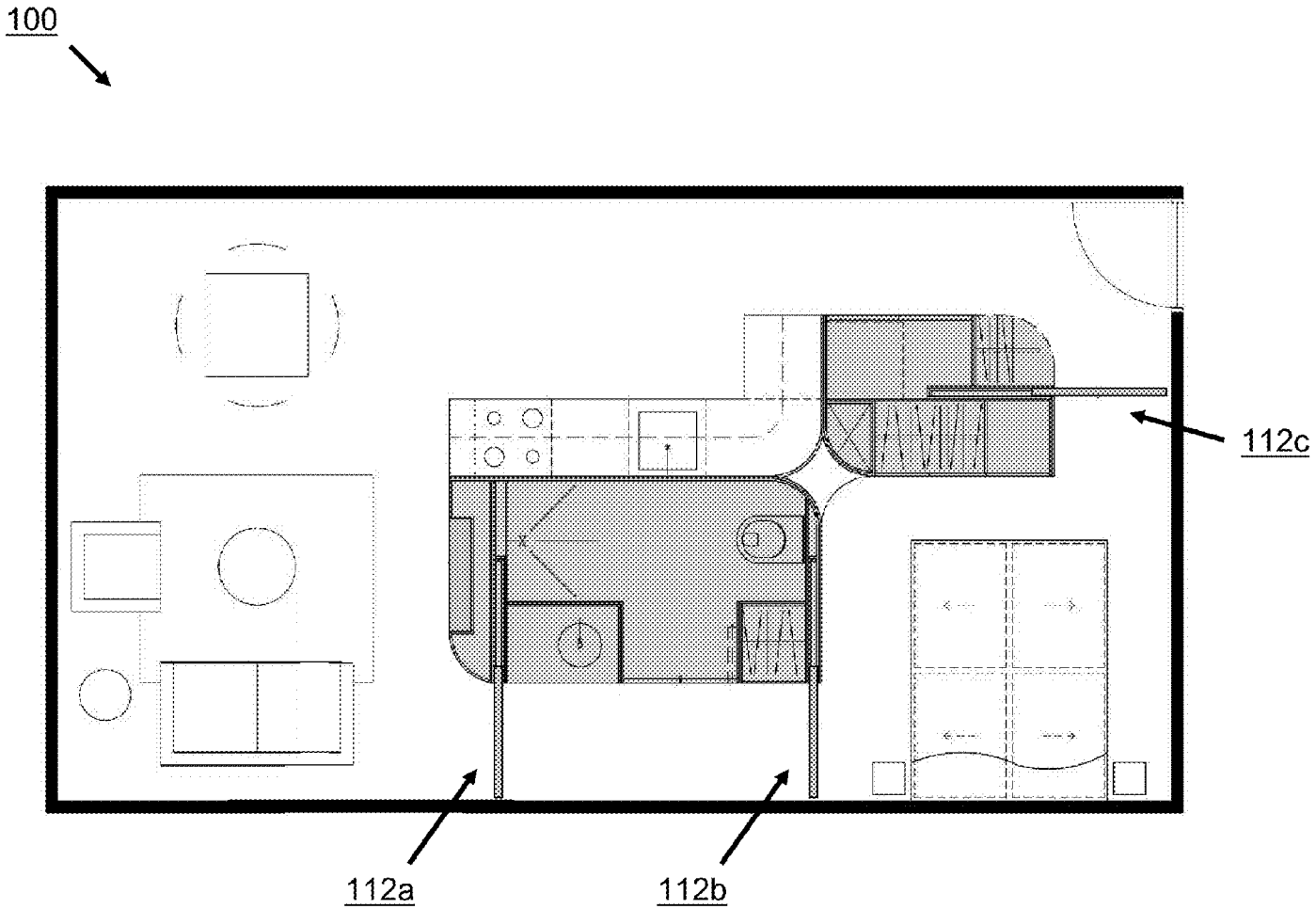
FIG. 1B is another floor plan of an embodiment of a housing unit with a plurality of prefabricated building module with extended partition elements.

Referring now to FIG. 1B, another floor plan of an embodiment of a housing unit with a plurality of prefabricated building modules with extended partition elements is illustrated. As shown, modules 102 and 104, discussed below in more detail, may comprise one or more partitions 112*a*-112*c* (referred to generally as a partition or partitions 112). In some embodiments, partitions 112*a*-112*c* may comprise walls or doors coupled to a building module 102 or 104 such that the partition may be retracted into a recess of the building module, or extended outwardly from the building module, such as to meet an opposing wall of housing unit 100. In some embodiments, the partitions are mounted or constructed to be attached to the building module, such that the retracted position of the partition is within a wall of the building module, such as between an interior and exterior wall of the building module. In some embodiments, the partition is a separate and self-contained module attached to the building module and in these embodiments, the self-contained module provides the housing for the retracted position of the partition.

The partitions may comprise wood, plastic, glass, metal, or any combination of these or other materials. In one embodiment, the partitions may extend from the floor to ceiling of the housing unit, while in other embodiments, the partitions may be shorter. In other embodiments, the partitions may be partially extended such that they do not contact an opposing wall. In some embodiments, a partition may comprise soundproofing material. In one embodiment, a partition may comprise a handle or doorknob or other fixture for extending and retracting the partition. In another embodiment, the partition may comprise a latch and/or a lock, such that the partition may be extended to meet or engage a corresponding fixture on a wall of housing unit 100. In many embodiments, partitions 112*a*-112*c* may be closed to provide privacy for users of an area of housing unit 100. In some embodiments, a partition may be extended outwardly and horizontally from the top of the building module to provide a ceiling, shade or any other type of covering.

Although partitions 112*a*-112*c* are illustrated as sliding into and out of corresponding recesses in building modules 102 and 104, in some embodiments, partitions 112*a*-112*c* may comprise swinging doors with hinges coupled to one of an exterior surface of a building module and a wall of housing unit 100. In another embodiment, partitions 112*a*-112*c* may comprise accordion-style doors. In a further embodiment, the accordion-style door may be fixed to a wall of housing unit 100, or may be fixed to a building module 102 or 104. In a still further embodiment, an accordion-style door may retract into a wider, but shallower recess building module 102 or 104 than would be required or used for a stiff sliding door.

Figure 2A:
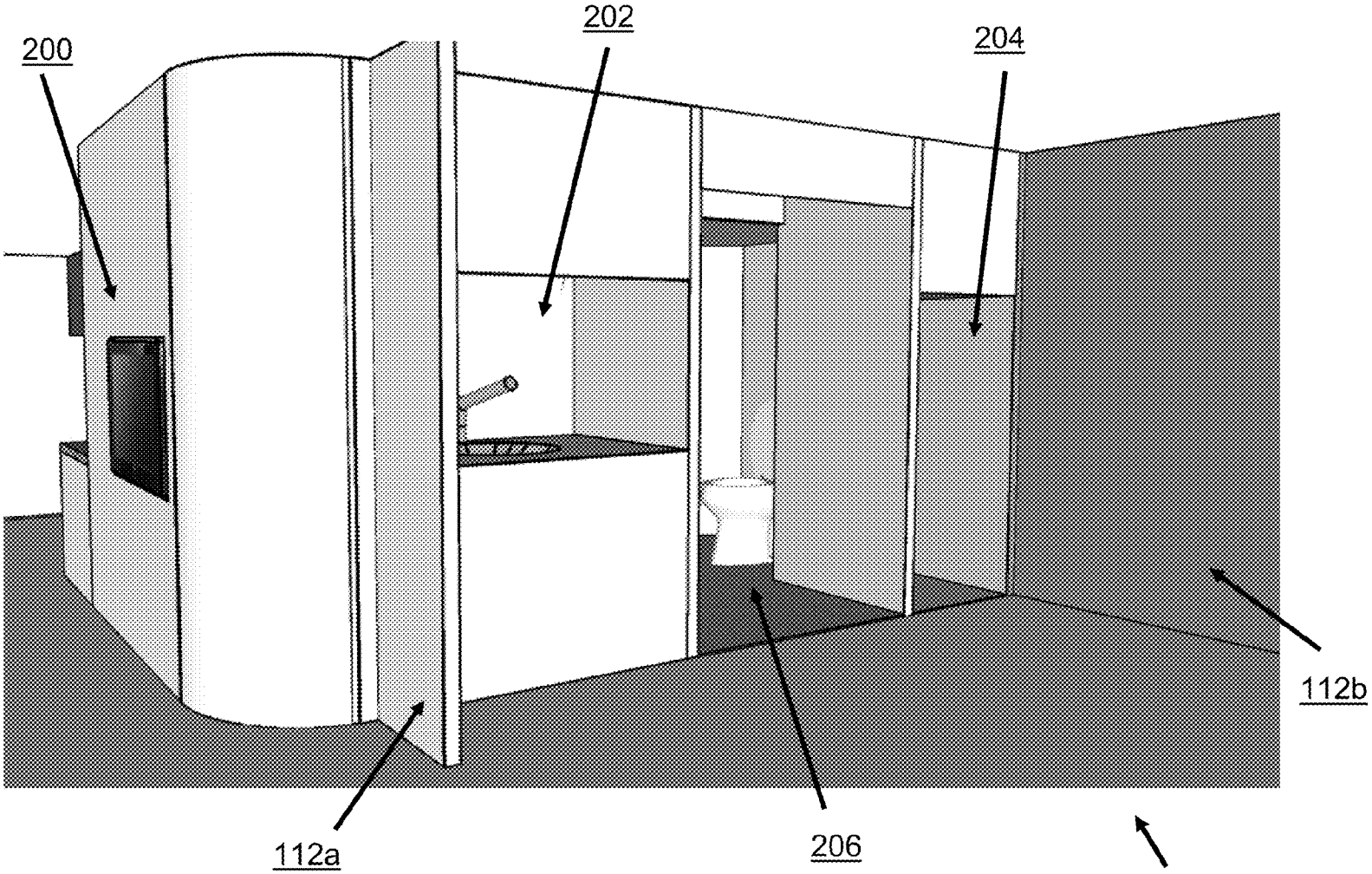
FIG. 2A is a perspective view of an embodiment of a prefabricated building module.

Shown in FIG. 2A is a perspective view of an embodiment of a prefabricated building module 102. Briefly, a building module 102 may comprise one or more partitions 112*a* and 112*b*, which are shown partially refracted and fully extended, respectively. A building module 102 may further comprise a niche 200, or a vanity alcove comprising a sink 202, a closet space 204. Furthermore, a building module 102 may encompass an interior 206 comprising one or more plumbing fixtures. A building module 102 may further comprise a door (not illustrated) for access to interior 206.

Referring to FIG. 2A and in more detail, in some embodiments, a building module 102 may comprise a plurality of finished outer wall surfaces of one or more materials, including wood, tile, drywall, glass, plastic, metal, stone, ceramic, or any combination thereof. Additionally, building module 102 may encompass an interior volume with a plurality of finished inner wall surfaces of one or more materials including wood, tile, drywall, glass, plastic, metal, stone, ceramic, or any combination thereof. In one embodiment, the finished inner wall surfaces may comprise a water-resistant material, such as tile, metal, marble, plastic, or any other water-resistant material or materials. In some embodiments, the finished inner wall surfaces may have a first portion, such as a lower portion, constructed of a water-resistant material, and a second portion, such as an upper portion, constructed of a non-water resistant material. In another embodiment, the building module 102 may include a floor in interior 206 constructed of a water-resistant material, such as tile, metal, marble, plastic, or any other water-resistant material or materials. In a further embodiment, the floor may comprise a drain. In a still further embodiment, the floor may be configured to slope slightly towards the drain, such that water on the floor of the building module will flow into said drain.

In many embodiments, building module 102 may comprise plumbing, HVAC, electrical, telephone, internet, cable, and similar connections. For example, in one such embodiment, the finished outer wall surfaces of building module 102 may comprise one or more electrical outlets, telephone or ethernet jacks, cable television connectors, or other similar outlets. In some embodiments, all service connections for a housing unit 100 may be made through a building module 102. For example, in an embodiment of a multi-unit building, one housing unit 100 may be positioned vertically over a second housing unit 100, each housing unit comprising a building module 102 identically positioned within the housing unit. Water, electrical, sewage, and similar service lines may be run vertically between the two housing units 100 connecting to each building module 102, using standardized connectors between each floor. Accordingly, construction of the building may be faster and less expensive.

As shown, in some embodiments, a building module 102 may comprise one or more partitions 112, which may be extended to meet walls of a housing unit 100. With one or more partitions extended, a space between the wall and the building module 102 may be defined. In an embodiment with opaque partitions, the defined space may allow for privacy for a user of the housing unit. For example, a resident may extend partitions to define a private dressing space.

In some embodiments, a building module 102 may comprise a niche or niches 200 set into an exterior finished surface of the building module. In one embodiment, a niche 200 may be sized to contain a flat screen video device, such as an LCD television. In a further embodiment, a niche 200 may comprise one or more electrical outlets. In another embodiment, a niche 200 may comprise one or more cable television outlets or similar connections.

In some embodiments, a building module 102 may comprise a vanity alcove 202. In one such embodiment, vanity alcove 202 may comprise a sink and/or a mirror. In many embodiments, the sink may comprise water connections as discussed above. In some embodiments, a vanity alcove 202 may comprise a lighting fixture or fixtures.

In another embodiment, a building module 102 may comprise a storage alcove or closet 204. In one embodiment, a storage alcove 204 may comprise shelving or hangers for storing and hanging clothing or other items. In some embodiments, a storage alcove 204 may comprise a lighting fixture or fixtures. In one embodiment, a storage alcove 204 may comprise a door (not illustrated) to close over the alcove, such as a swinging door, an accordion-style door, or a sliding door. In another embodiment, a storage alcove 204 may comprise a curtain (not illustrated).

In many embodiments, a building module 102 may comprise an interior 206 that may be closed off by a door (not illustrated). Interior 206 may comprise one or more plumbing fixtures, such as a toilet, a sink, and a shower head. In one embodiment, interior 206 may comprise a bathtub. In some embodiments, interior 206 may comprise a lighting fixture or lighting fixtures. In another embodiment, interior 206 may comprise one or more vents and/or fans to remove humidity and bring in fresh air. In yet another embodiment, interior 206 may comprise a heating element to warm the interior. In one embodiment, interior 206 may comprise a shower room or a combination shower and bathroom. For example, in one such embodiment, a resident of housing unit 100 may disrobe, enter interior 206, close a door (not illustrated) and shower with waste water passing through a drain in the water-resistant floor of the building module 102.

In many embodiments, a building module 102 may not include a ceiling, but rather just one or more walls and/or a floor. Thus, in these embodiments, a building module 102 may not require additional ventilation, as air may freely pass over the walls from the surrounding areas of the unit.

Figure 2B:
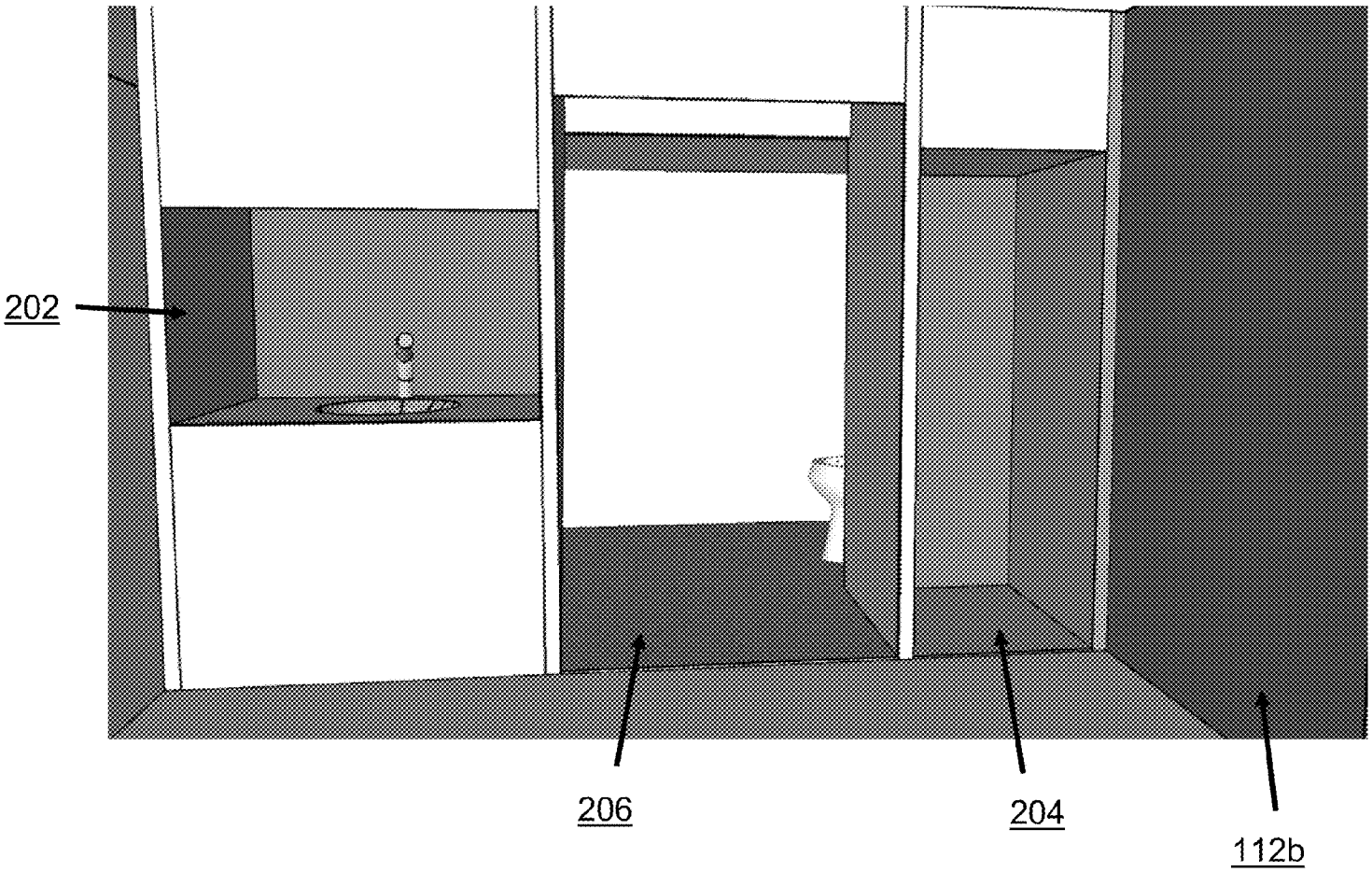
FIG. 2B is another perspective view of an interior of an embodiment of a prefabricated building module.

Shown in FIG. 2B is another perspective view of an interior of an embodiment of a prefabricated building module 102. Briefly, FIG. 2B shows another view of an embodiment of a building module 102 with a vanity alcove 202, a storage alcove 204, and an interior 206, to show relative depths, sizes, and positioning. In some embodiments, building module 102 may be configured differently. For example, in one embodiment, storage alcove 204 may be positioned adjacent to vanity alcove 202, with an entrance to interior 206 to one side of the two alcoves.

Figure 2C:
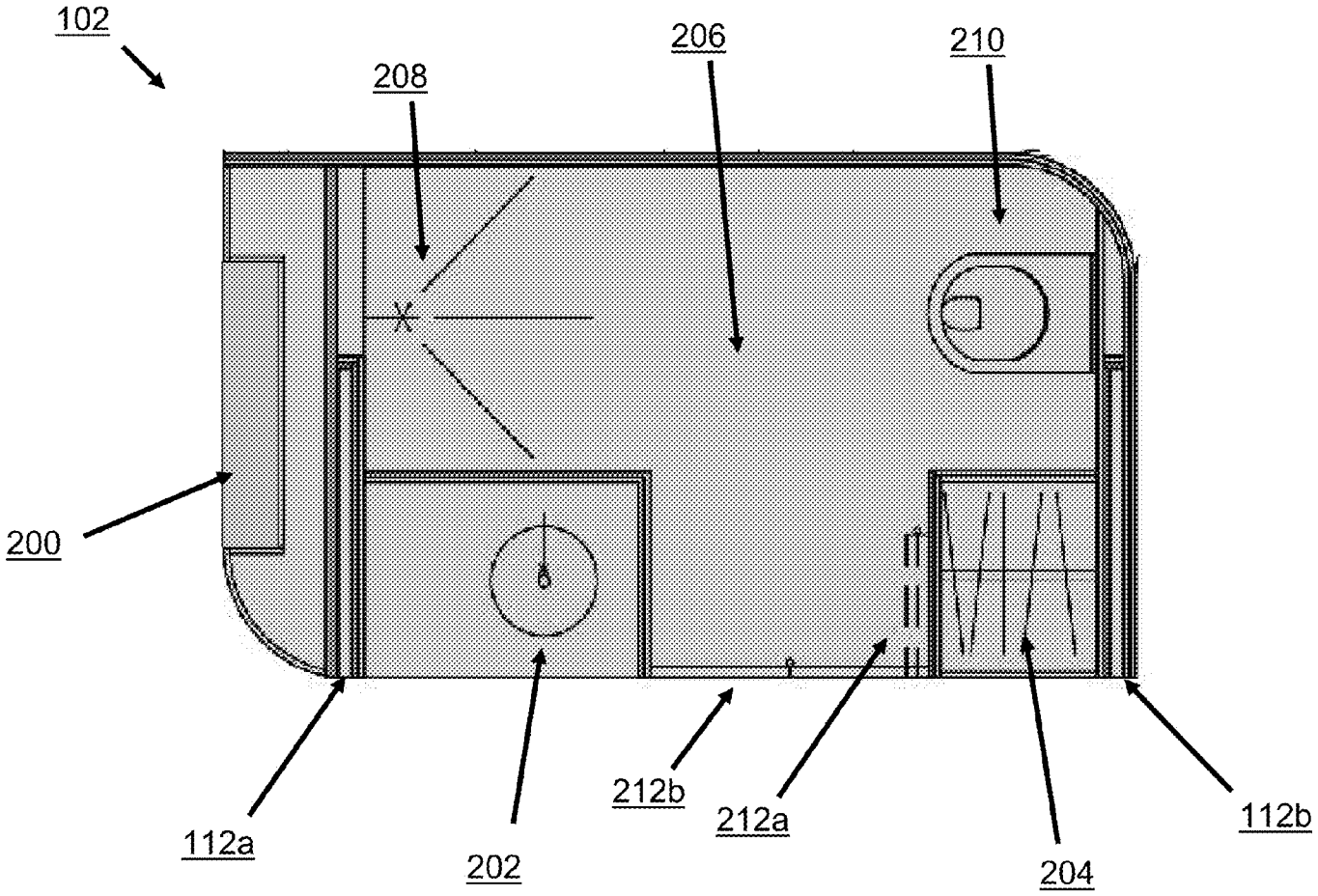
FIG. 2C is another floor plan of an embodiment of a prefabricated building module.

Shown in FIG. 2C is another floor plan of an embodiment of a prefabricated building module 102. Briefly, a building module 102 may comprise one or more extendable partitions 112*a* and 112*b*, a niche in an outer finished wall surface 200, a vanity alcove 202, a storage alcove 204, and an interior 206. In some embodiments, an interior 206 may comprise a shower head 208 and a toilet 210. In another embodiment, a building module 102 may comprise a door 212 to interior 206, which is illustrated in both open (212*a*) and closed (212*b*) positions. In some embodiments, as shown, door 212 may be hinged both at one end and in a middle portion such that door 212 folds against one inner finished wall surface of building module 102.

Figure 3A:
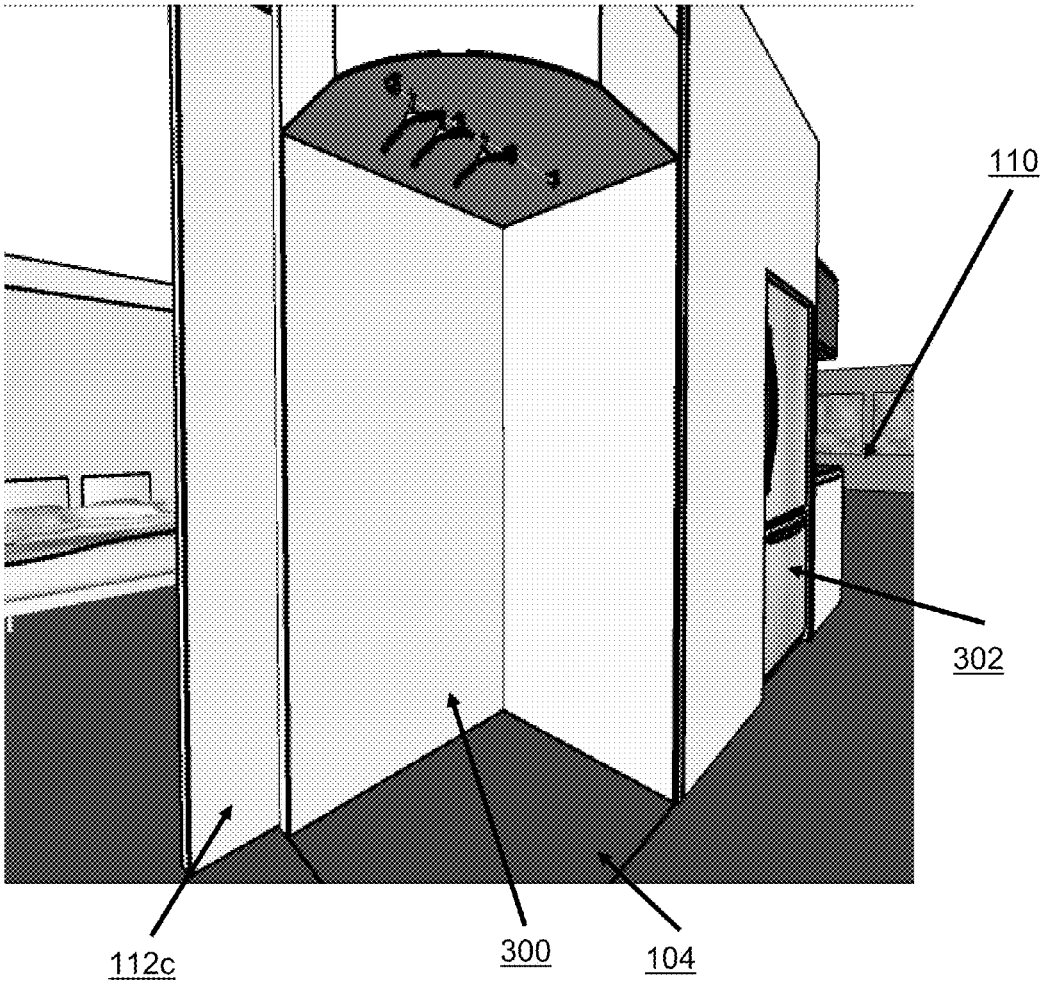
FIG. 3A is another perspective view of an embodiment of a prefabricated building module.

Referring now to FIG. 3A, illustrated is a perspective view of an embodiment of a prefabricated building module 104. Briefly, in one embodiment, a building module 104 may comprise a storage space 300. A building module 104 may further comprise a storage area 302, which may comprise an appliance such as a refrigerator. In some embodiments, a building module 104 may comprise a partition 112*c*. As shown, the placement of a building module 104 may define a living area, such as a kitchen 110. In some embodiments, a building module may comprise one or more enclosed storage areas which may comprise one or more doors (not illustrated).

In some embodiments, a building module 104 may comprise a plurality of finished outer wall surfaces of one or more materials, including wood, tile, drywall, glass, plastic, metal, stone, ceramic, or any combination thereof. Additionally, building module 104 may encompass an interior volume with a plurality of finished inner wall surfaces of one or more materials including wood, tile, drywall, glass, plastic, metal, stone, ceramic, or any combination thereof.

In many embodiments, building module 104 may comprise plumbing, HVAC, electrical, telephone, internet, cable, and similar connections. For example, in one such embodiment, the finished outer wall surfaces of building module 104 may comprise one or more electrical outlets, telephone or ethernet jacks, cable television connectors, or other similar outlets. In some embodiments, all service connections for a housing unit 100 may be made through a building module 104. For example, in an embodiment of a multi-unit building, one housing unit 100 may be positioned vertically over a second housing unit 100, each housing unit comprising a building module 104 identically positioned within the housing unit. Water, electrical, sewage, and similar service lines may be run vertically between the two housing units 100 connecting to each building module 104, using standardized connectors between each floor. Accordingly, construction of the building may be faster and less expensive.

As shown, in some embodiments, a building module 104 may comprise one or more partitions 112, which may be extended to meet walls of a housing unit 100. With one or more partitions extended, a space between the wall and the building module 104 may be defined. In an embodiment with opaque partitions, the defined space may allow for privacy for a user of the housing unit. For example, a resident may extend partitions to define a bedroom.

Figure 3B:
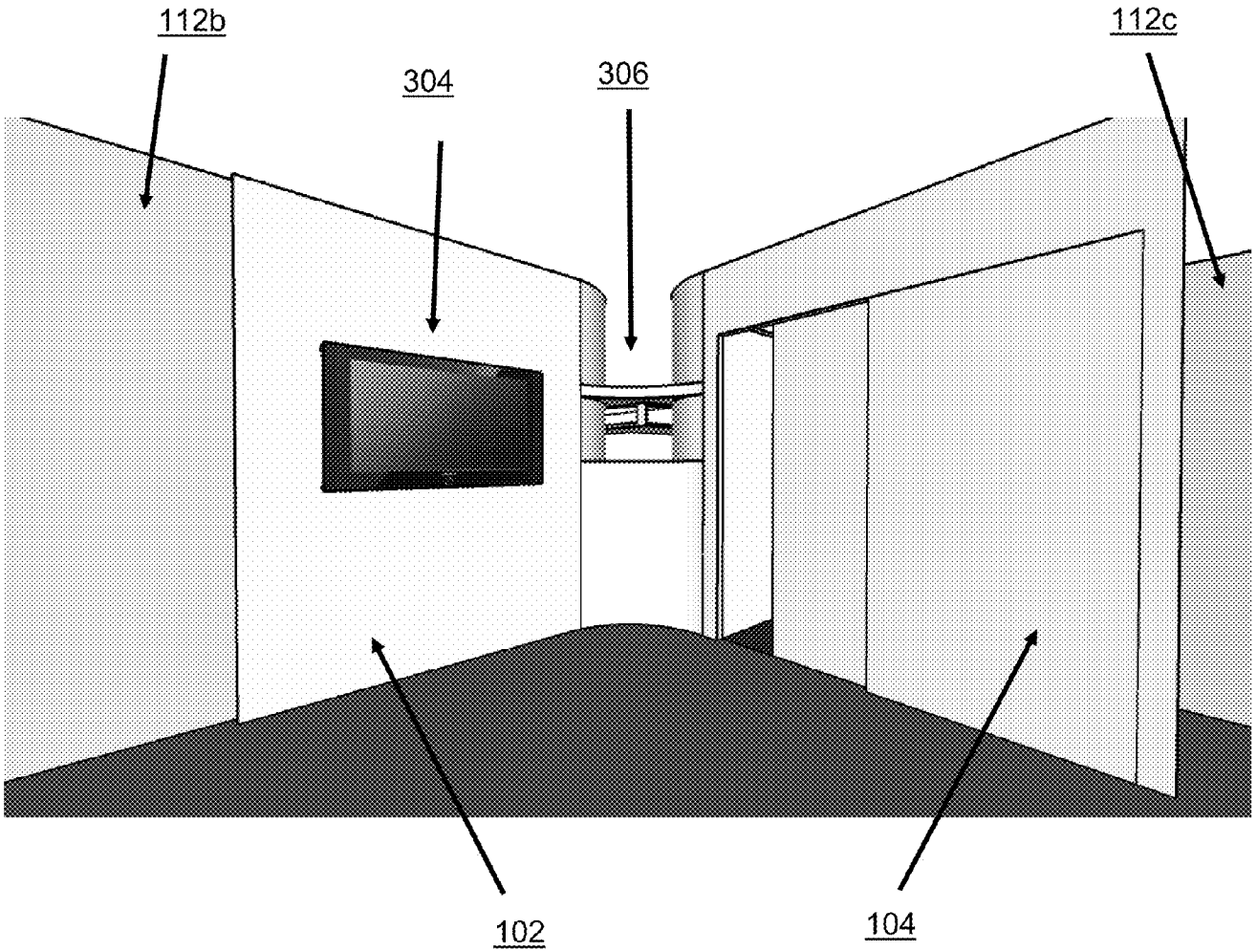
FIG. 3B is another perspective view of an embodiment of a prefabricated building module with extended partition elements.

Shown in FIG. 3B is another perspective view of an embodiment of a prefabricated building module with extended partition elements. Specifically, FIG. 3B shows an example of an embodiment of two building modules 102 and 104 positioned at an offset and angles to one another such that a living space, such as a bedroom, is defined. As shown, in some embodiments a building module 102 may comprise a partition 112*b* that may be extended to close off a living space. Similarly, a building module 104 may comprise a partition 112*c* that may similarly be extended to close off the living space and provide privacy. In some embodiments, a building module, such as building module 102, may comprise an alcove 304 which may be sized to contain a flat screen viewing device, such as an LCD or plasma television. In some embodiments, alcove 304 may comprise electrical and/or cable television connections. In some embodiments, a building module, such as building module 104, may comprise a storage area (not illustrated) concealed behind a finished outer surface of building module 104.

In many embodiments, a junction surface or wall 306 may be constructed between a first building module and a second building module. Said junction surface 306 may comprise shelves or cabinets, and may be opaque or translucent. Junction surface 306 may comprise wood, tile, drywall, glass, plastic, metal, stone, ceramic, or any combination thereof. In some embodiments, a second junction surface 306 (not illustrated in FIG. 3B) may be constructed between the first building module and second building module such that a junction space is defined between the two surfaces. An embodiment of this may be seen more clearly in FIG. 1A between building module 102 and building module 104. In some embodiments, the junction space may comprise utility hookups or connections between a building module 102 and building module 104, or between a first housing unit 100 and second, vertically positioned housing unit 100, as discussed above.

Figure 3C:
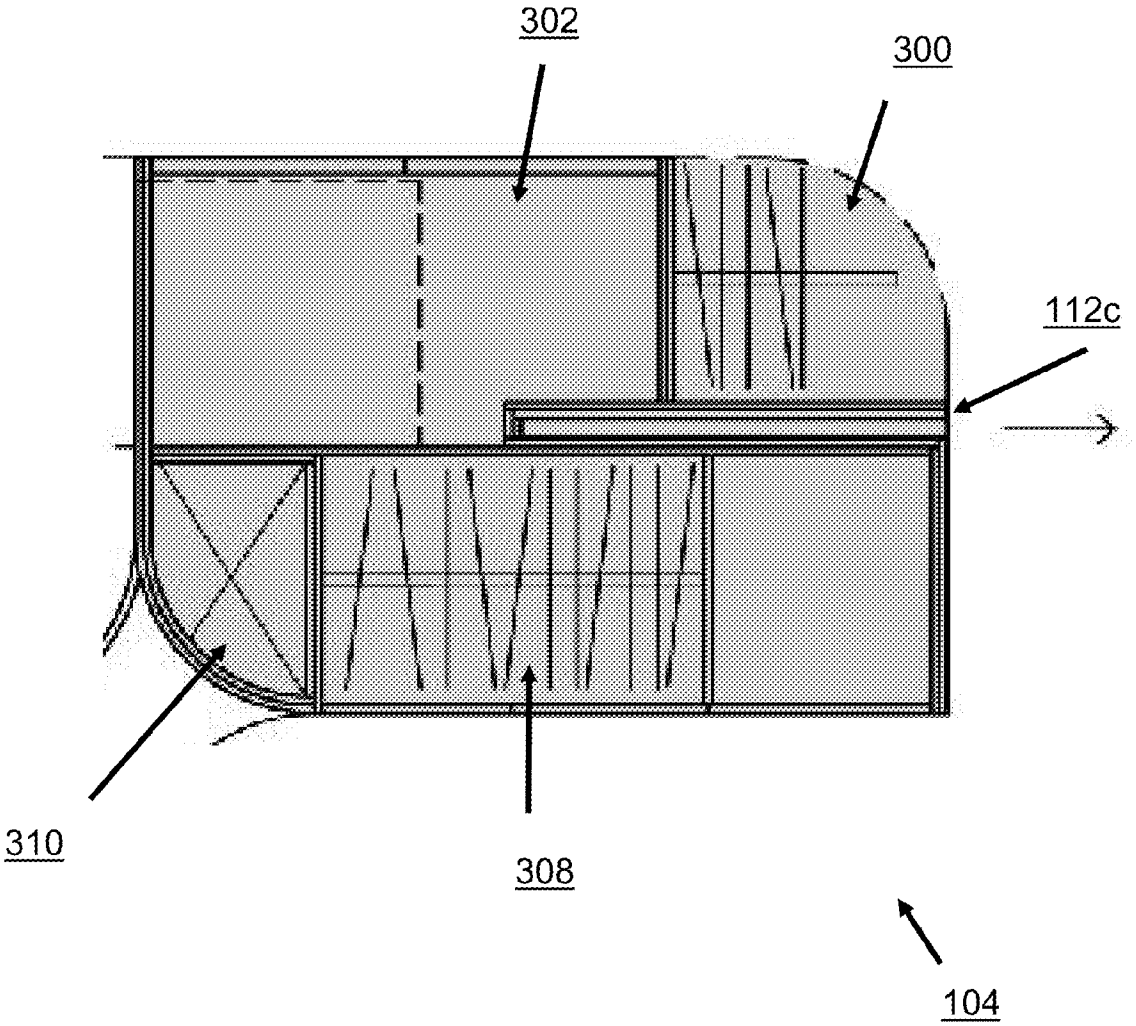
FIG. 3C is another floor plan of an embodiment of a prefabricated building module.

Shown in FIG. 3C is a floor plan of an embodiment of a prefabricated building module 104. Briefly, a building module 104 may comprise one or more extendable partitions 112*c*, and one or more storage spaces 300, 302, and 308. In some embodiments, an area 310 of building module 104 may comprise inter-floor utility connections, as discussed above.

In some embodiments, storage spaces 300, 302 and 308 may comprise a door or doors, which may be hinged or sliding doors. For example, in one embodiment, storage space 300 may be used for coats and/or shoes by an entry to housing unit 100 and may not include a door. Alternately, a storage area 308 may comprise a closet for a bedroom of housing unit 100 and may include a door or doors. In some embodiments, a storage area 302 may comprise shelves, for use as a pantry. In other embodiments, a storage area 302 may comprise an appliance, such as a refrigerator, a washing machine, a clothes dryer, or a combination washing machine and clothes dryer. In a further embodiment, storage area 302 may comprise electrical and plumbing connections for appliances. In another further embodiment, storage area 302 may comprise soundproofing material, such that the transmission of noise from an appliance to living spaces of housing unit 100 is diminished.

In some embodiments, a building module 104 may comprise a utility area 310. In many embodiments, utility area 310 may be positioned at a corner of building module 104 that is adjacent to a corresponding corner of a second building module, such as a building module 102. In these embodiments, utilities, such as water, electricity, HVAC, and drainage may be supplied to a building module 102 from a building module 104 through a junction space between two junction surfaces 306, discussed above. In some embodiments, a building module 104 may comprise an access panel to utility area 310 for service and maintenance.

Figure 4:
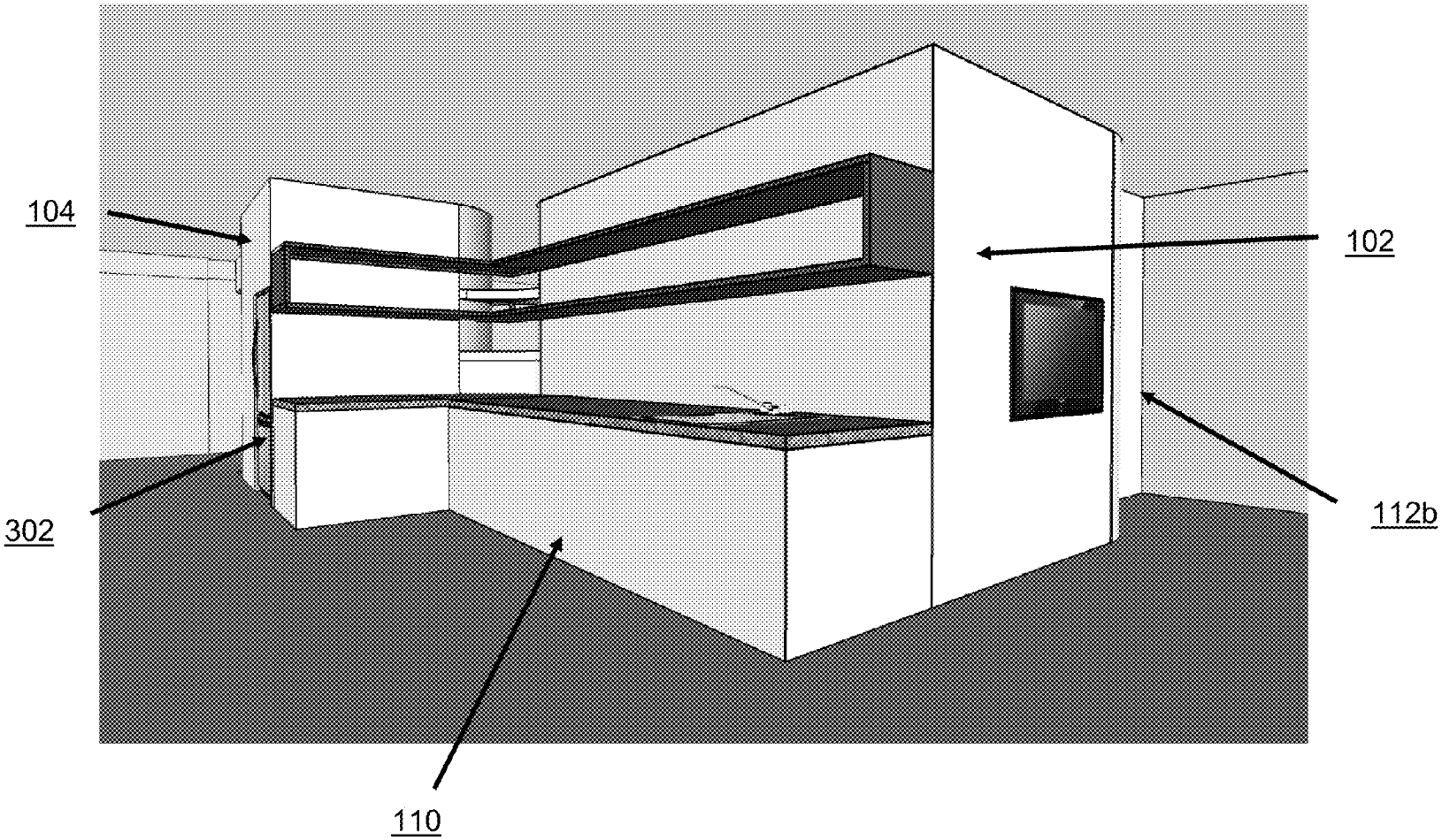
FIG. 4 is a perspective view of an embodiment of a housing unit with a plurality of prefabricated building modules.

Shown in FIG. 4 is a perspective view of an embodiment of a housing unit with a plurality of prefabricated building modules. As shown, a building module 102 may be positioned diagonally adjacent to a building module 104 such that the two building modules define a living space 110, such as a kitchen. Building module 102 may comprise a partition 112*b*, shown extended. Building module 104 may comprise a storage area 302, with an appliance such as a refrigerator. In some embodiments as shown, cabinetry and counters may be attached to finished outer wall surfaces of a building module 102 and/or a building module 104 to create a kitchen space. Said kitchen space may comprise lighting, electrical outlets, and water and drainage connections provided by a building module 102 or building module 104, as discussed above.

Multiple room housing units may use a plurality of prefabricated building modules to define the living space. For example, a bedroom may use a first prefabricated building module to define a master bathroom or a walk-in closet. A second bedroom may use a second prefabricated building module to define another bathroom or walk-in closet. The remaining living space may also include a prefabricated building module to define a kitchen, bathroom or utility room. In a multi-room housing unit, any combination of one or more different types of prefabricated building modules may be used to create and define the living spaces.

Figure 5:
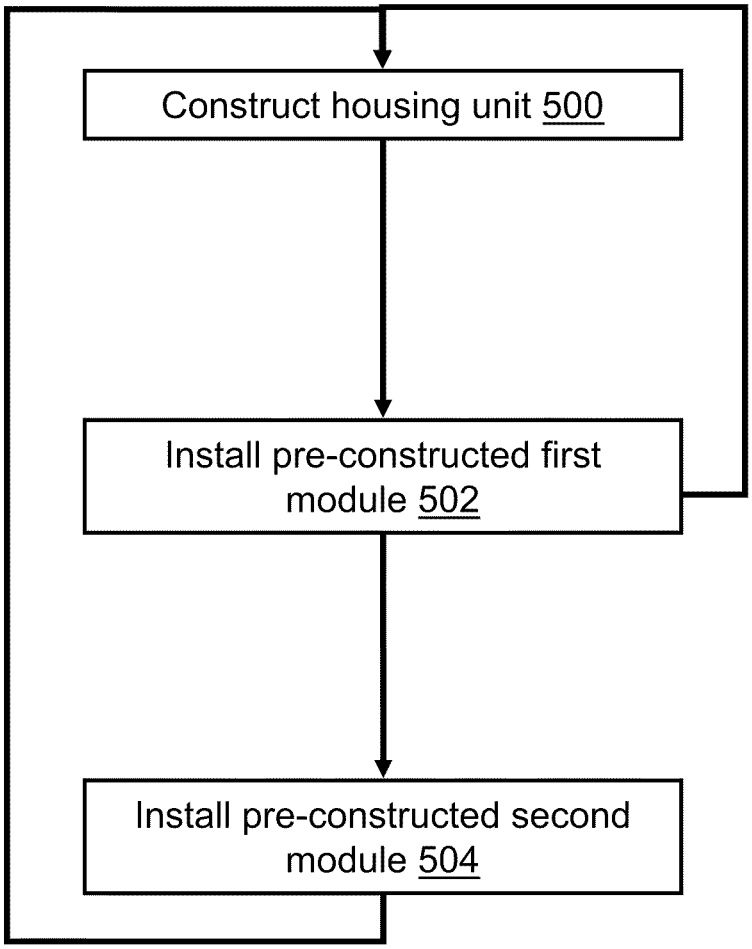
FIG. 5 is a flow chart of an embodiment of a method of constructing a living space using the prefabricated building module.

Shown in FIG. 5 is a flow chart of a method of constructing a living space using one or more prefabricated building modules. Briefly, at step 500, a housing unit may be constructed. At step 502, a first prefabricated building module may be installed. In some embodiments, steps 500 and 502 may be repeated to create a multi-unit housing structure. In other embodiments, at step 504, a second prefabricated building module may be installed. In these embodiments, steps 500-504 may be repeated to create a multi-unit housing structure.

Still referring to FIG. 5 and in more detail, at step 500, a housing unit may be constructed. The entity responsible for establishing the housing unit may receive one or more prefabricated construction modules, such as from one or more manufacturers of such modules. For example, the owner of the housing unit may order such prefabricated construction modules and receive via shipping such modules at the site of the housing unit. In another example, the owner of the housing unit may build such modules on site at the housing unit. In yet a further example, the owner of the housing unit may order one or more components of the module and assemble and/or further build the module at the site of the housing unit or another site controlled by the owner. In some embodiments, the manufacturer of the modules and the owner of the housing unit are one in the same.

In some embodiments, the housing unit may be constructed with predetermined dimensions, including height, length, and width. In some embodiments, a plurality of housing units may be constructed adjacent to one another in a multi-unit building, with identical predetermined dimensions. In another embodiment, a first one or more housing units may be constructed with a first set of predetermined dimensions, and a second one or more housing units may be constructed with a second set of predetermined dimensions. For example, a first set of dimensions may define a one-bedroom housing unit, while a second set of dimensions may define a two-bedroom or luxury one-bedroom housing unit. In some embodiments, constructing a housing unit may comprise erecting and finishing walls, a floor and a ceiling, installing a door or doors, and installing a window or windows. In many embodiments using building modules described above, walls may not need to comprise electrical, HVAC, or plumbing lines, and floors and ceilings may need only an area for pass-through of connections from one housing unit to another housing unit.

Although shown as a separate step, in some embodiments, step 500 may be partially performed, steps 502 and/or 504 performed, and step 500 completed. Based on the design of the module herein, the module may be installed or deployed during any state of construction. For example, in one such embodiment, a housing unit may be partially constructed with a floor and walls, but no ceiling. A first and/or a second prefabricated building module may be placed inside the walls, for instance, with a crane. A ceiling may then be added to the housing unit to complete construction. In another embodiment, a housing unit may be constructed with floor and ceiling and three walls. A first and/or a second prefabricated building module may be placed inside the three walls and rolled, lifted or slid into position. The fourth wall may then be erected, completing construction. In a further embodiment, the fourth wall may be partially constructed, with a portion the width of a building module left open to allow the building module to be installed into the housing unit. In still other embodiments, the fourth wall may be fully constructed, but include an opening, such as one or more doors, of a width sufficient to allow a building module to be rolled or slid into the unit.

In some embodiments, steps 502 and 504 may comprise installing a first and second, respectively, prefabricated building module into a housing unit. In some embodiments, installing a prefabricated building module into a housing unit may comprise providing a building module, positioning the building module within the housing unit, and connecting the building module to one or more service or utility lines, such as to any type and form of electrical, plumbing or HVAC system. In another embodiment, installing a prefabricated building module into a housing unit may comprise mechanically fixing the building module to a floor and/or ceiling of the housing unit. For example, in one such embodiment, the building module may be fixed to a sub-floor of the housing unit with a plurality of bolts. In one embodiment, a building module including a service area, such as a bathroom, may be installed into the housing unit. In another embodiment, the building module may be positioned in the housing unit such that finished outer wall surfaces of the module are spaced apart from walls of the housing unit in a manner to define, with the walls of the housing unit, limiting walls of multiple functional living spaces arranged about the prefabricated module in the housing unit. In one embodiment in which the building modules comprise an extendable partition or partitions, the building module may be positioned spaced apart from walls of the housing unit by a distance corresponding to a distance that said partition or partitions may be extended outward from one of the finished outer wall surfaces of the building module to a wall of the housing unit.

In some embodiments of the methods and systems described above, building modules may be configured prior to installation in a custom manner, responsive to desires of the architect, building owner, or housing unit owner. For example, materials for inner and outer finished surface walls of a building module may be selected on a custom basis, as well as configuration of storage alcoves, partition types, plumbing fixtures and faucets, shelving, cabinetry, and other features. In some embodiments, multiple implementations of building modules may be configured differently and installed into the same multi-unit housing structure. Because custom configuration of a building module may be performed external to the housing structure, the configuration need not delay construction. Accordingly, a housing structure may be built in a highly efficient manner, in spite of having many different configurations of building modules. Furthermore, although embodiments with two building modules are illustrated, in some embodiments, a second storage module may be installed in an adjacent manner to either a first storage module or a wet module to further define additional living spaces. Similarly, in some embodiments, a second wet module may be installed, further defining additional living spaces. Furthermore, these additional modules need not be configured in an identical manner to other modules. For example, a first wet module may include a shower, while a second wet module has a bath. Similarly, a first storage module may include a clothes washer and dryer, while a second storage module includes a refrigerator, or a water heater or furnace.

As discussed above, in many embodiments, a building module may have a height that is less than the interior height of the unit it is to be installed into, such that the unit's floor and ceiling may be constructed and the module may be slid or rolled into the unit. In some embodiments, the building module may include wheels, while in other embodiments, the building module may be lifted via a forklift or crane. In still other embodiments, the building module may be placed on one or more dollies, rolled into place, and lowered from the dollies. Accordingly, the building module may be positioned within the unit at a location chosen by the designer or owner with great flexibility.

Although discussed above in connection with residential spaces, the building module or modules described herein may be used in non-residential spaces, such as offices. For example, a building module may be placed within a unit and the partitions and walls of the unit may serve to define one or more offices, meeting rooms, storage spaces, or any combination of residential and non-residential spaces.

While various embodiments of the methods and systems have been described, these embodiments are exemplary and in no way limit the scope of the described methods or systems. Those having skill in the relevant art can effect changes to form and details of the described methods and systems without departing from the broadest scope of the described methods and systems. Thus, the scope of the methods and systems described herein should not be limited by any of the exemplary embodiments and should be defined in accordance with the accompanying claims and their equivalents.

What is claimed:

1. A building structure, comprising:

a housing unit including (a) a ceiling having a ceiling height and (b) a plurality of walls defining a continuous interior floor space; and a prefabricated building module having a height that is less than the ceiling height of the housing unit such that the prefabricated building module is selectably movable, within the housing unit and at a clearance distance below the ceiling, between multiple locations about the continuous floor space, the prefabricated building module defining at least a portion of a living space for the housing unit, the prefabricated building module comprising:

a set of adjoining walls, each adjoining wall having an inner wall surface and an outer wall surface, the set of adjoining walls defining at least the portion of the living space for the housing unit, one or more fixtures designed for the living space, the one or more fixtures mounted via a structure attached to an interior of the prefabricated building module bound by the inner wall surfaces; and one or more partitions, each partition mounted between the inner wall surface and the outer wall surface of a respective one of the adjoining walls of the prefabricated building module, the one or more partitions extendable outwardly from a retracted position within the prefabricated building module to an extended position, wherein the prefabricated building module is spaced apart, in each of the multiple locations and with the one or more partitions in the retracted position, from all of the walls of the housing unit defining the continuous interior floor space, such that the one or more partitions are extendable toward one or more of the plurality of walls defining the continuous interior floor space to thereby define at least a portion of one or more additional living spaces within the housing unit adjacent to the prefabricated building module.

2. The building structure of claim 1, wherein the one or more partitions are movable between the retracted position and the extended position to define the portion of one or more living spaces adjacent to the prefabricated building module.

3. The building structure of claim 1, wherein one or more lights are mounted within the interior of the prefabricated building module at a location to emanate light externally from the prefabricated building module lengthwise along a predetermined gap between the outer wall surface and the ceiling of the housing unit, the one or more lights providing light for the interior of the prefabricated building module and one or more living spaces adjacent to the prefabricated building module.

4. The building structure of claim 1, wherein at least one of the inner wall surfaces or one of the outer wall surfaces is finished.

5. The building structure of claim 1, wherein the living space comprises a bathroom.

6. The building structure of claim 1, wherein a second set of one or more fixtures designed for a second living space are mounted to one or more outer wall surfaces of the prefabricated building module.

7. The building structure of claim 6, wherein the second living space comprises a kitchen.

8. The building structure of claim 1, wherein the prefabricated building module is attached to a second prefabricated building module defining at least a portion of a third living space for the housing unit.

9. The building structure of claim 8, wherein at least one of the living space, the second living space and the third living space comprises a closet, a utility room, a bedroom, a living room, a den, an office or a library.

10. A method of creating the building structure according to claim 1, the method comprising:

incorporating the prefabricated building module into the housing unit to define a living space;

receiving, at a location of the housing unit, the prefabricated building module, the prefabricated building module defining at least a portion of the living space for the housing unit and having mounted partitions extendable outwardly from the prefabricated building module to define one or more additional living spaces within the housing unit adjacent to the prefabricated building module;

moving the prefabricated building module within the housing unit, a height of the prefabricated building module falling below a ceiling height of the housing unit; and identifying within the housing unit a first living space provided by the prefabricated building module and a second living space provided by space adjacent to the prefabricated building module and one or more interior walls of the housing unit.

11. The method of claim 10, wherein the receiving step further comprises building the prefabricated building module at the location of the housing unit.

12. The method of claim 10, wherein the receiving step further comprises assembling portions of the prefabricated building module at the location of the housing unit.

13. The method of claim 10, wherein the moving step further comprises sliding the prefabricated building module into the housing unit, the height of the prefabricated building module fitting under the ceiling height of the housing unit.

14. The method of claim 10, wherein the prefabricated building module is not attached to an interior wall of the housing unit.

15. The method of claim 10, wherein the moving step further comprises integrating the one or more fixtures of the prefabricated building module with one or more corresponding HVAC, plumbing or electrical system of the housing unit.

16. The method of claim 10, further comprising establishing a lighting system within the first living space provided by the prefabricated building module that emanates light into the second living space via the prefabricated building module lengthwise along a predetermined gap between an outer wall surface of the prefabricated building module and a ceiling of the housing unit, the lighting system emanating light to the interior of the prefabricated building module.

17. The method of claim 10, wherein the identifying step further comprises extending a partition of the one or more partitions from a retracted position within the prefabricated building module to an extended position, adjacent to or flushed to an interior wall of the housing unit.

18. The method of claim 10, wherein the identifying step further comprises extending the one or more partitions of the prefabricated building module to define one or more additional living spaces within the housing unit.

19. The method of claim 10, further comprising installing a second prefabricated building module into the housing unit to provide a third living space within the housing unit.

* * * * *